US005453825A

United States Patent [19]

Lipiz

[11] Patent Number: 5,453,825

[45] Date of Patent: Sep. 26, 1995

[54] METHOD AND APPARATUS FOR CONTROLLING THE TRANSPORT AND THE POSITIONING OF SHEETS

[75] Inventor: Javier Lipiz, Wernau, Germany

[73] Assignee: Eastman Kodak Company, Rochester, N.Y.

[21] Appl. No.: 259,725

[22] Filed: Jun. 14, 1994

[30] Foreign Application Priority Data

Jun. 16, 1993 [DE] Germany ..... 43 19 872.4

[51] Int. Cl.[6] ..... G03G 21/00

[52] U.S. Cl. ..... 355/316; 356/385; 250/559.29

[58] Field of Search ..... 355/309, 311, 355/316; 271/265, 227; 356/385, 429; 400/579, 708, 711; 250/561, 571; 226/20

[56] References Cited

U.S. PATENT DOCUMENTS 4,291,825 9/1981 Glanz ..... 250/571 X

FOREIGN PATENT DOCUMENTS 0152873 2/1985 European Pat. Off. ..... B41J/19/76

2202087 1/1972 Germany .

54-122144 9/1979 Japan ..... 356/385

55-37357 3/1980 Japan .

61-155803 7/1986 Japan ..... 356/385

61-148305 7/1986 Japan ..... 250/561

63-191003 8/1988 Japan ..... 250/561

64-2961 1/1989 Japan .

*Primary Examiner*—A. T. Grimley
*Assistant Examiner*—Nestor R. Ramirez
*Attorney, Agent, or Firm*—Larry P. Kessler

[57] ABSTRACT

Method and apparatus for controlling the transport and the positioning of sheets. Using a measuring unit (2) which comprises a light source (12), an optical element (14) and photoelectric elements (16), the position of a sheet (6) is monitored and controlled. For this purpose, the output signals of the photoelectric elements (16) are supplied to a control unit (20) which, on the basis of data supplied by the printer countrol unit (24), provides corresponding control signals for the sheet transport rollers (34) or the drive means (36) of the transport (38) for re-adjustment of the measuring unit (2).

1 Claim, 3 Drawing Sheets

METHOD AND APPARATUS FOR CONTROLLING THE TRANSPORT AND THE POSITIONING OF SHEETS

BACKGROUND OF THE INVENTION

1. Field of the Invention

The invention relates, in general, to a method and apparatus for controlling the transport and the positioning of sheets in printers or the like, comprising a light source as well as photoelectric elements located at a distance from, and opposite such light source.

2. Description of the Prior Art

A typical photoelectric measuring unit for use in sheet-finishing and sheet-processing machines is shown in German OS 2 202 087. In that unit, a plurality of photoelectric receivers are arranged in the area of the reference line. Each individual photoelectric receiver or each group of such receivers is associated with a light source. The distance of the individual receivers results in a measuring accuracy in the range of tenths of a millimeter. The sheet to be transported is guided in the area between the light sources and the photoelectric receivers. Depending on how far the sheet has moved into the ray path between light source and receiver, a corresponding number of the receivers is shielded. Using a suitable evaluation circuit, the position of the sheet can be determined within the range of the measuring accuracy attainable in the device concerned. This unit only allows the position of an incoming sheet to be monitored while not allowing the positioning or the transport of the sheets to be controlled.

Further, European Patent No. EP 0 152 873 discloses a device for controlling sheet transport in a printer. For this purpose, slotted disks are used which are mounted on the driving shaft of the sheet transport motor. Each of the slotted disks is associated with a photoelectric element which is used for detecting the individual slots in the disk. The electric signals generated by the photoelectric elements serve to control the stepping motor of the sheet transport roller. By means of these signals a fine adjustment of the stepping motor is possible. However, this device is unable to compensate for slip-related changes in the position of the sheet during sheet transport.

SUMMARY OF THE INVENTION

It is the purpose of this invention to provide a device which allows a sheet to be positioned and transported respectively in a contact-free and inexpensive manner and with an accuracy within the μm range. An additional purpose of the invention is to compensate for slippage between the sheet and the sheet transport rollers by a suitable control and thereby to obtain high-quality prints. In accordance with this invention, a light source is associated with an optical beam expanding element, which together with the photoelectric elements, form a measuring unit arranged in a housing. A control unit is connected, via an electric line, to the outputs of the photoelectric elements.

The device according to the invention is advantageous in that the mechanical requirements which have to be fulfilled are low in order that an accuracy in the μm range be reached for the positioning of sheets. Moreover, in the device according to the invention, an edge of the sheet to be positioned is used to determine the location of the sheet in a contact-free manner, such determination serving as a control signal for the transport rollers. Slippage necessarily to be encountered is compensated. Another advantage of the device according to the invention is that the unit which senses the sheet edge is re-adjustable so that fine adjustment of the sheet transport in the μm range can be attained over the entire sheet length.

The invention, and its objects and advantages, will become more apparent in the detailed description of the preferred embodiments presented below.

DETAILED DESCRIPTION OF THE INVENTION

Figure 1:
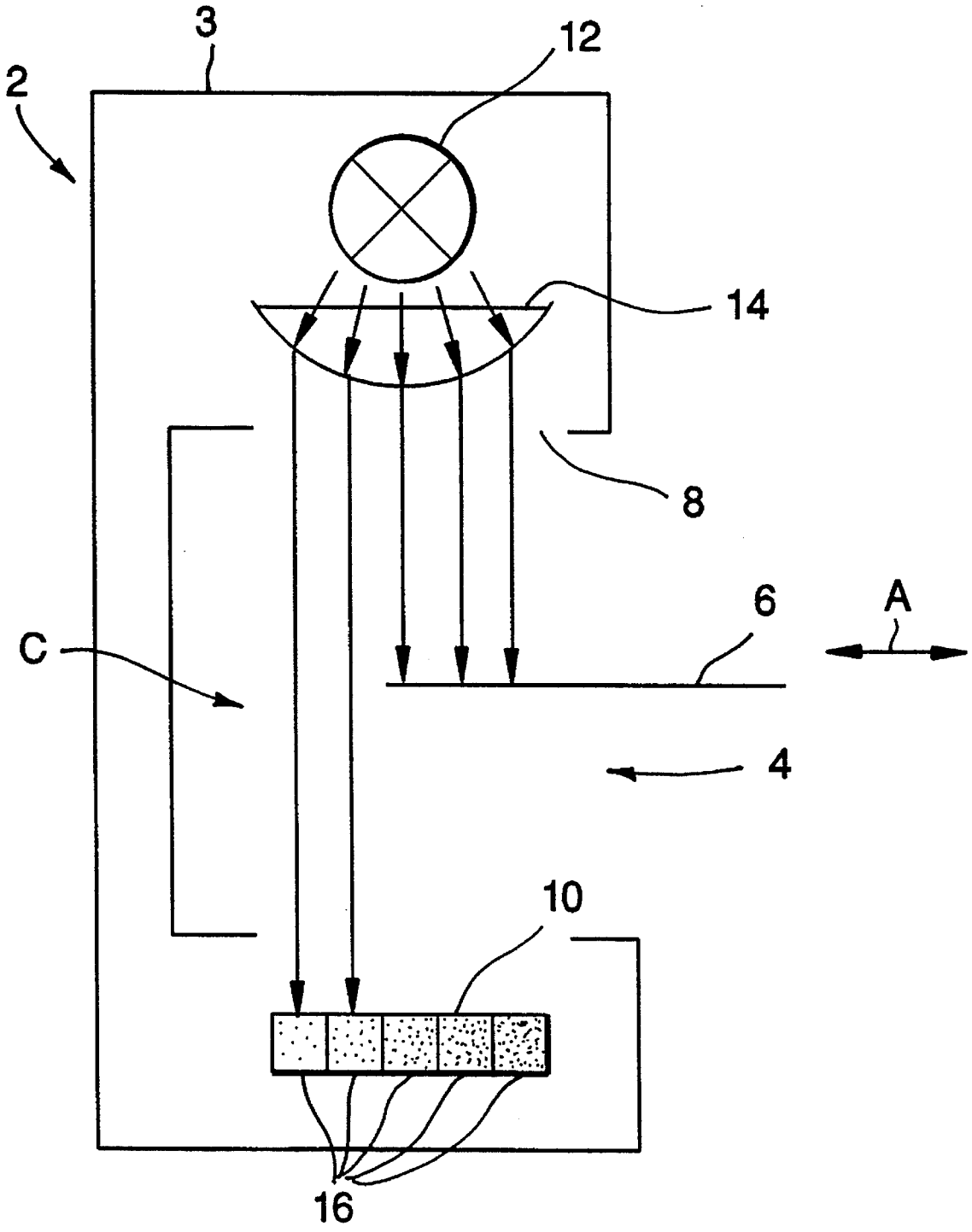
FIG. 1 is a diagrammatic view of the measuring unit, according to this invention, for determining the position of a sheet.

FIG. 1 shows schematically a measuring unit 2, according to this invention, for determining the position of a sheet (for example, cut bond paper). The measuring unit 2 comprises a housing 3 with an opening 4 into which the lateral edge of the sheet 6 to be measured can be moved and from which it can be removed, respectively, in the direction of the double arrow A, perpendicular to the direction of sheet travel. Housing 3 moreover includes two oppositely arranged light-permeable openings 8 and 10. The light emitted by a light source 12, and rendered parallel (see parallel arrows C) by an optical element 14 positioned downstream of the light source, leaves housing 3 through opening 8. On the opposite side, the light beam re-enteres housing 3 through opening 10. Behind the opening 10, photoelectric elements 16 are arranged which generate an electric signal in response to the amount of radiation incident on them. In the embodiment, the optical element 14 is a collective lens and the photoelectric elements 16 correspond to the individual cells of a CCD array. Depending on the position of the sheet 6 to be measured, such individual cells of the CCD array are either shielded from, or illuminated by the incident light.

Figure 2:
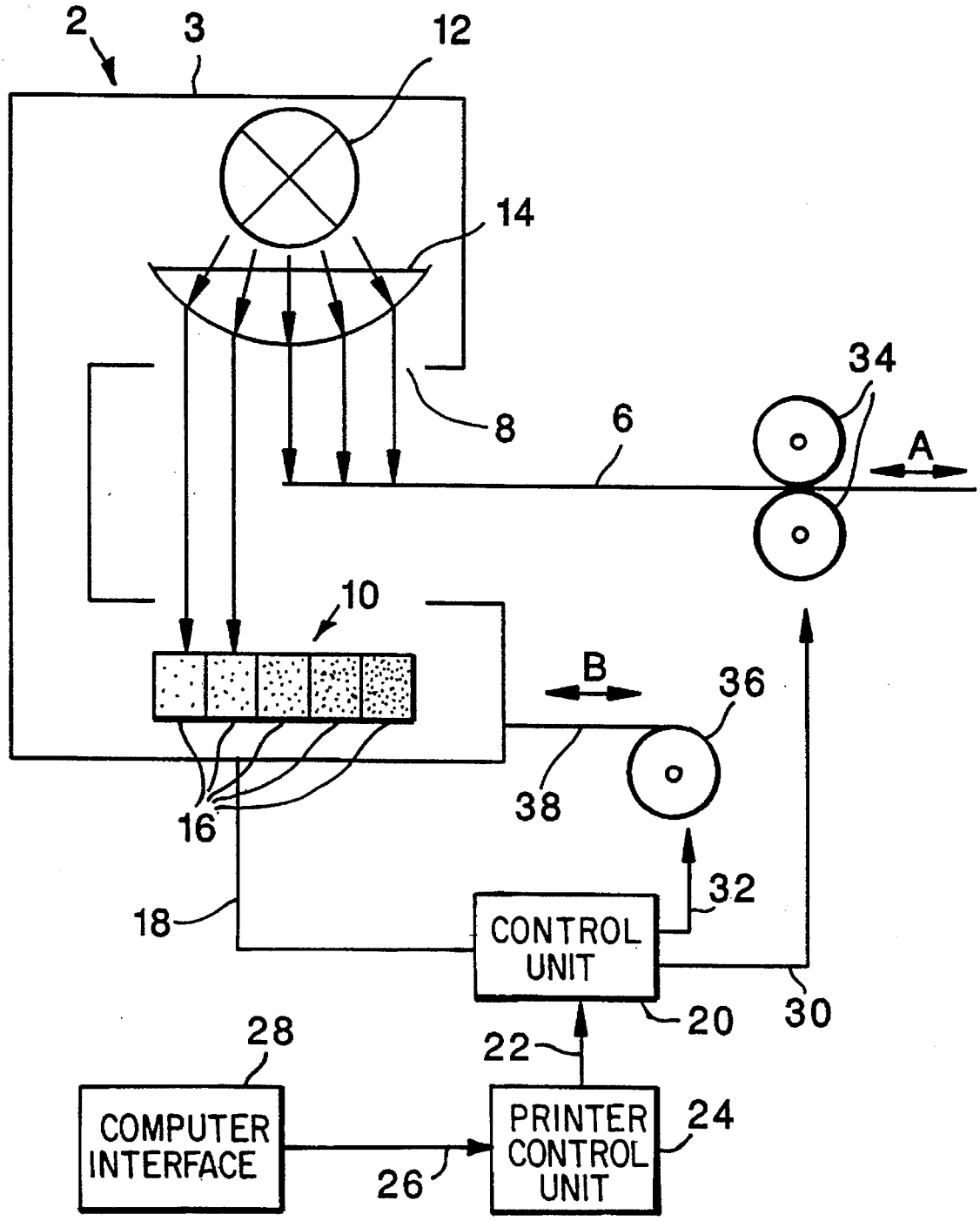
FIG. 2 is a diagrammatic view of the device, including the measuring unit of FIG. 1, for controlling the positioning or the transport of a sheet according to this invention.

In FIG. 2, the measuring unit 2 illustrated in FIG. 1 is schematically represented in connection with a control for the transport of sheets such as used in printers. The electric signals generated by the light incident on the photoelectric elements 16 are applied to a control unit 20 via an electrically conductive connection 18. Control unit 20 is additionally supplied, through a line 22, with electric signals from a printer control unit 24 which is connected to a computer interface 28 by a line 26. Control unit 20 has a first and a second output line 30 and 32. The first output line 30 is connected to a drive means (not illustrated) to supply such drive means with control signals for the driving of positioning rollers 34. The sheet is positioned in the direction of the double arrow A. The second output line 32 is also connected to a drive means 36 which is joined to the measuring unit 2 via a transport element 38. The electric signals supplied through the second output line 32 cause the measuring unit 2 to move with the assitance of the drive means 36 and transport element 38 in the direction of the double arrow B.

Figure 3:
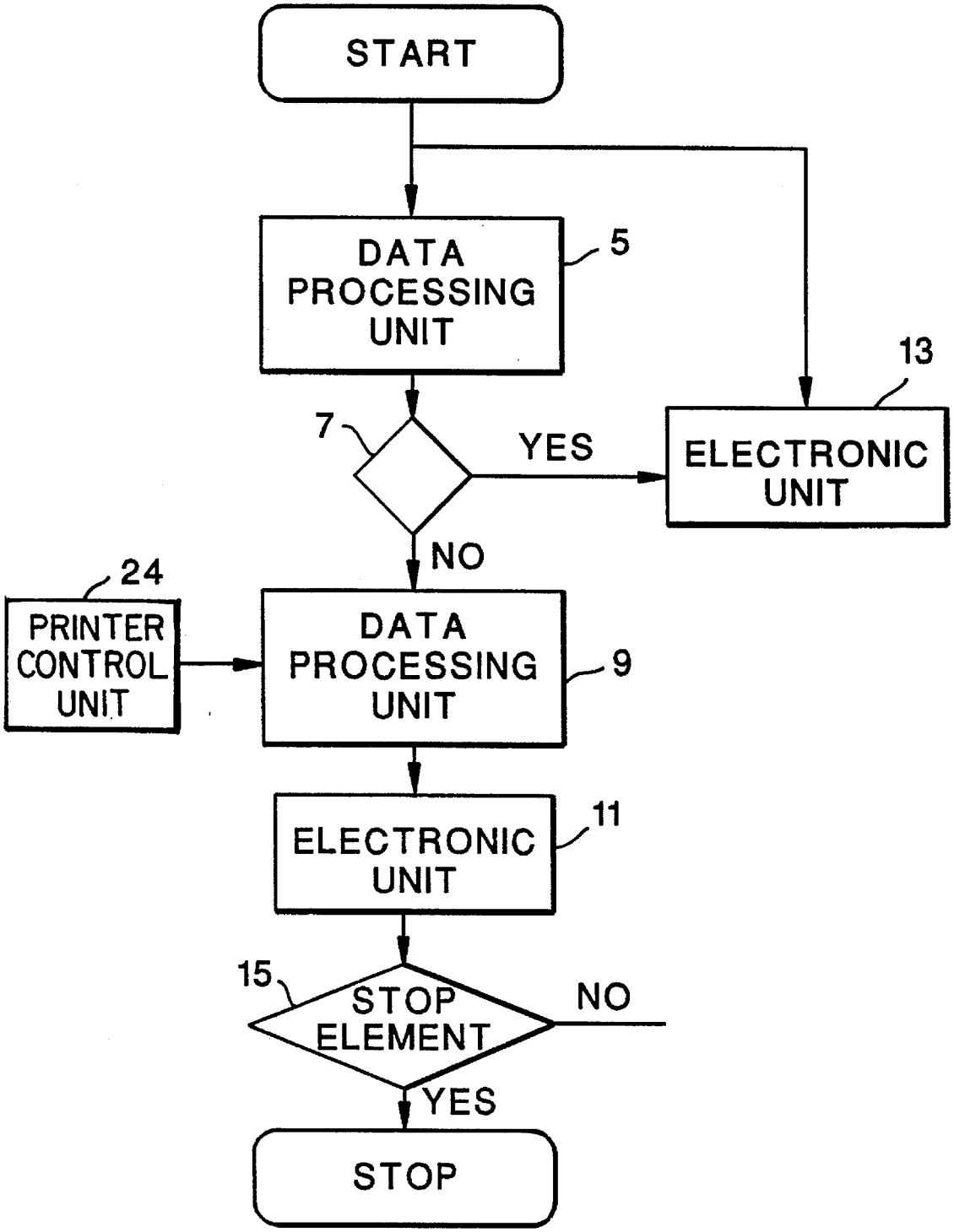
FIG. 3 is a flow diagram of the method according to this invention, for controlling the positioning or the transport of a sheet.

The method of controlling the transport and the positioning of sheets 6 is described with reference to the flow diagram in FIG. 3. After the printing operation has been started and the sheet 6 has been aligned in its initial position, the position of the sheet 6 is controlled until the printing operation has been terminated. In a first process step, the ratio of shielded to illuminated photoelectric elements 16 is determined in a data processing unit 5. In the subsequent step 7, it is checked whether the ratio of the shielded to the illuminated photoelectric elements 16 tends toward zero, i.e. whether almost all photoelectric elements 16 receive light. If "no", a second data processing unit 9 determines, with the assistance of data supplied by the printer control unit 24, whether there is a difference between the desired value and the actual value of the position of a sheet 6. If there is a deviation, a corresponding control signal is supplied to the electronic unit 11 of the drive means of the transport rollers 34 in order that the desired value be obtained.

If step 7 reveals that the ratio of the shielded to the illuminated photoelectric elements 16 tends toward zero, i.e. almost all of the photoelectric elements are illuminated, transport of sheet 6 by the transport rollers 34 is stopped. Subsequently, a control signal is supplied to the electronic unit 13 of the drive means 36 in order to cause a re-adjustment of the measuring unit 2 until almost all of the photoelectric elements are shielded. Now, the position of the edge of the sheet 6 to be transported can once again be controlled without measuring unit 2 having to be re-adjusted until the paper edge has passed over approximately all of the photoelectric elements 16. Re-adjustment of the measuring unit 2 has to be repeated until printing has been terminated. Subsequently, the process is terminated by a stop element 15. When another print is produced the process starts again.

The invention has been described in detail with particular reference to preferred embodiments thereof, but it will be understood that variations and modifications can be effected within the spirit and scope of the invention as set forth in the claims.

I claim:

1. The method of controlling the transport and the positioning of sheets in printers or the like wherein the location of an edge of a sheet (6) can be determined by means of a measuring unit (2) comprising a light source (12) and photoelectric elements (16), said transport and positioning method comprising the steps of:

(a) determining the ratio of shielded to illuminated photoelectric elements (16), by which the location or the transport of the sheet (6) is defined;

(b) comparing the actual sheet position defined in step (a) to a predetermined desired position; and (c) in response to the difference between desired value and actual value, supplying a control signal to transport the sheet in the appropriate direction; and (d) when light impinges on almost all of the cells of the photoelectric elements (16), supplying an electric signal to re-adjust the measuring unit until almost all of the photoelectric elements (16) are shielded.

* * * * *